United States Patent [19]

LaVene

[11] 4,117,708

[45] Oct. 3, 1978

[54] METHOD OF MAKING HOUSING COVER AND TUBE

[75] Inventor: Leon F. LaVene, Durand, Mich.

[73] Assignee: Schmelzer Corporation, Durand, Mich.

[21] Appl. No.: 832,998

[22] Filed: Sep. 14, 1977

[51] Int. Cl.[2] ..... B21D 51/38

[52] U.S. Cl. ..... 72/324; 72/404; 113/116 UT; 113/116 DD

[58] Field of Search ..... 113/116 DD, 116 UT, 113/116 QA, 121 R, 121 E; 72/324, 379, 404, 356, 348

[56] References Cited

U.S. PATENT DOCUMENTS

| | | | |
|---|---|---|---|
| 1,165,421 | 12/1915 | Koenig | 113/116 DD |
| 1,232,973 | 7/1917 | Rateike | 113/116 UT |
| 1,642,166 | 9/1927 | McCaffrey | 113/116 UT |
| 2,098,797 | 11/1937 | Stevens | 113/116 UT |

*Primary Examiner*—Lowell A. Larson

*Attorney, Agent, or Firm*—Fisher, Gerhardt & Groh

[57] ABSTRACT

A method of forming a cup shaped housing member with an integral inlet tube extending radially to the axis of a cup shaped member from a flat strip of metallic material in progressive dies such that a tube is formed first to extend parallel to the axis of the cup shaped member and in subsequent progressive steps is moved first to a position extending at an angle to the axis and finally to a position extending radially to the axis of the cup shaped member.

11 Claims, 12 Drawing Figures

METHOD OF MAKING HOUSING COVER AND TUBE su

This invention relates to a method and apparatus for forming metal parts in progressive dies and more particularly it relates to the method and apparatus of forming a dished housing member with a tube extending radially from the axis of the housing member.

To provide a radially extending tube from a housing usually requires the welding of separate parts together or requires forming the assembly from molded materials such as plastic.

Typically, in the manufacture of small vacuum servo motors, housing parts are usually stamped from flat sheet metal in progressive dies and radially extending tubes that may be needed are formed separately affixed to the housing by welding or the like. Such operations are costly and cause distortion of the parts requiring additional sizing operations and sometimes result in flaws causing leakage making the servo motor inoperative.

It is an object of the invention to provide a method of forming sheet metal parts in which a generally cup shaped housing member has a radially extending tube.

Another object of the invention is to provide such a sheet metal part in which the tube and housng member are formed integrally with each other from a single piece of material.

A process of forming a cup shaped housing member with an integral inlet tube from a flat strip of metallic material has been provided in which progressive dies are used first to partially cut the strip and define a generally circular work piece portion after which progressive steps are used to form a tube off-set from the axis of the circular work piece portion and thereafter forming a cup shaped depression symmetrical to the axis of the member and with said tubular portion extending from the bottom of the cup shaped portion but to one side of the axis. Subsequently an annular wall is formed at an angle to the bottom wall of the cup shaped portion and includes the tube member so that it extends at an angle to the axis of the circular work piece portion. Following this, the annular wall containing the tube is displaced to a vertical position so that the tube extends radially to the cup shaped member.

These and other objects will be apparent from the following description and from the drawings in which.

Figure 2:
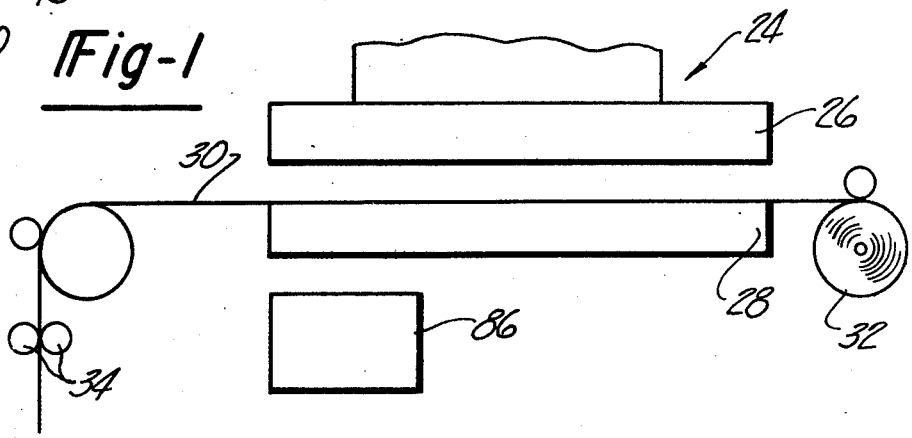
FIG. 2 is a diagrammatic view of a press incorporating progressive dies for performing the method of the present invention.
Figure 3A:
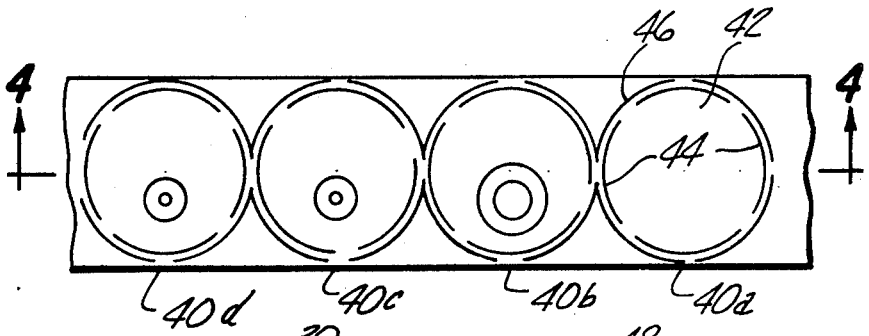
Figure 4:
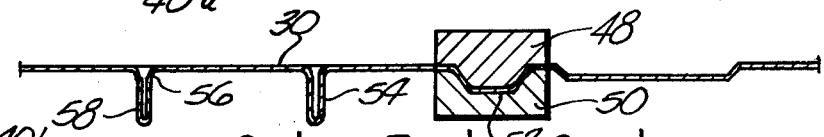
Figure 3B:
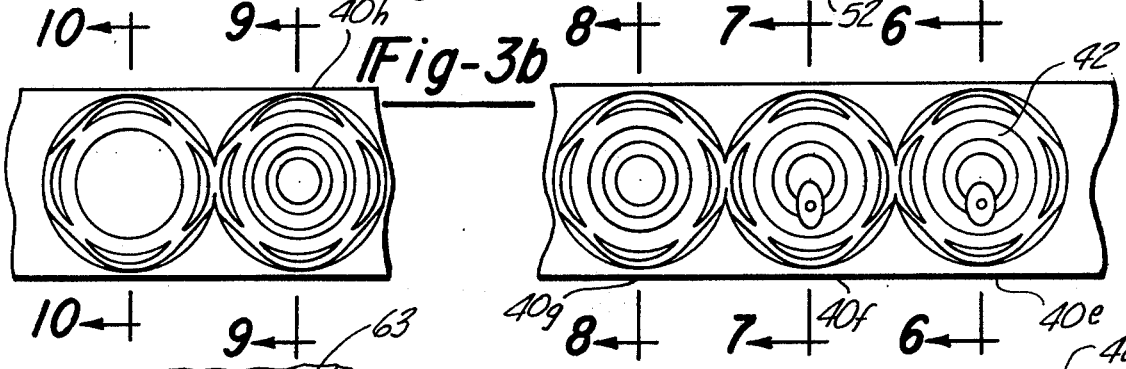

FIGS. 3*a* and 3*b* are a top plane view of a strip of material as it would appear at any one time after operation in the press of FIG. 2;

FIG. 4 is a cross-sectional view taken on line 4—4 in FIG. 3*a;*

Figure 5:
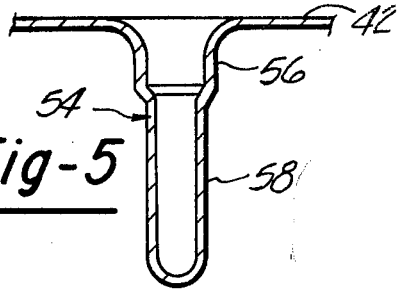

FIG. 5 is a cross-sectional view at an enlarged scale of a portion shown in FIG. 4;

FIGS. 6, 7, 8 and 9 are cross-sectional views taken on lines 6—6, 7—7, 8—8 and 9—9 all in FIG. 3*b;*

Figure 7:
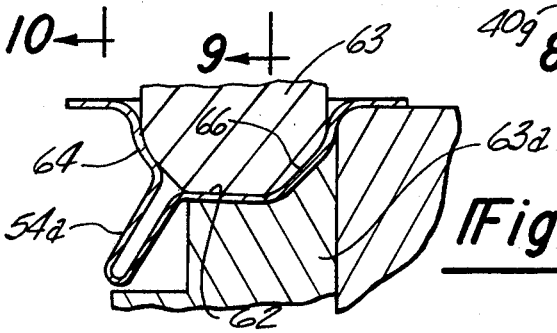
Figure 10:
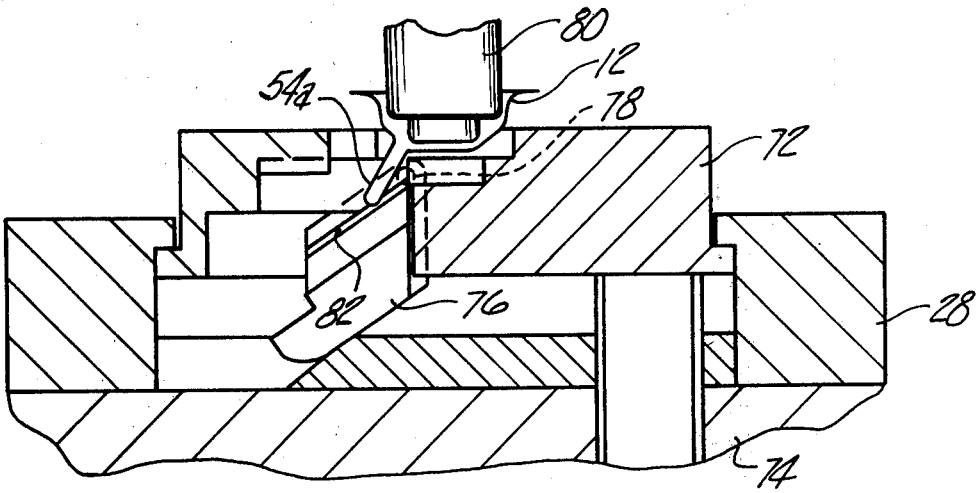
Figure 11:
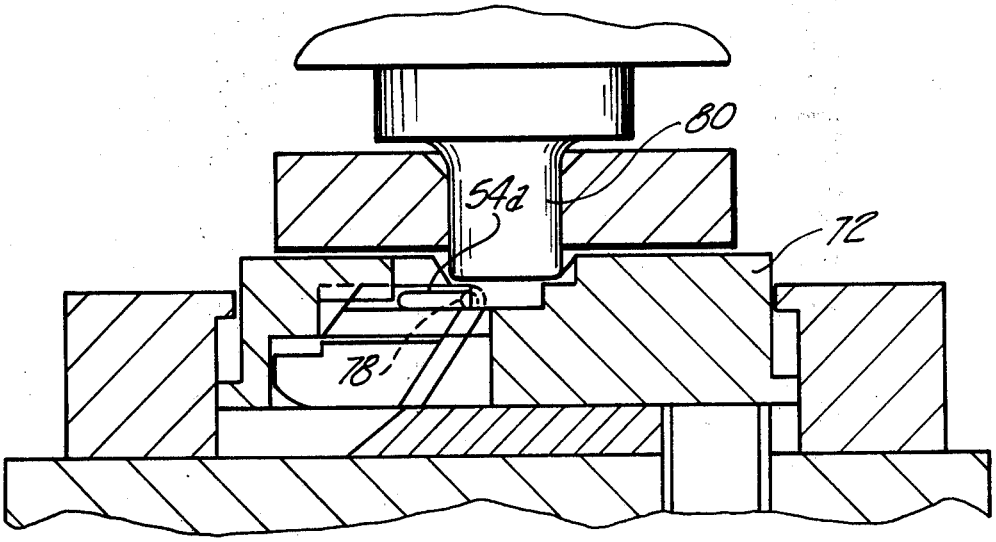

FIG. 10 is a cross-sectional view at an enlarged scale of the dies forming the part as seen in FIG. 7; and FIG. 11 is a cross-sectional view similar to FIG. 10 showing another position of operation of the apparatus.

Figure 1:
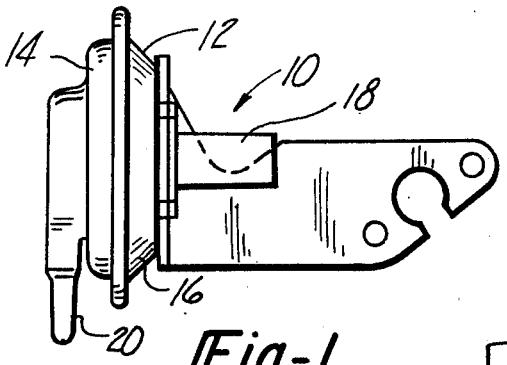
FIG. 1 is a plan view of a servo motor incorporating a part made by the method of the present invention.

Referring to the drawings and particularly to FIG. 1, the part to be formed by the method of the present invention is embodied in the servo motor which has a housing 12 formed by a pair of cover members 14 and 16 and an output member 18 which reciprocates in a opening in the cover 16. The cover member 14 is formed with a tube 20 which extends radially from the axis of the housing. The tube 20 is adapted to receive a vacuum hose to place the interior of the housing 12 in communication with a source of vacuum such as the manifold of a automobile engine, not shown.

In general the integral housing cover member 14 and tube 20 is formed in a reciprocating press 24 incorporating progressive dies forming parts of an upper die set 26 and mating dies in a lower die set 28. In the operation of such equipment, a strip of flat metallic material 30 is fed from a supply roll 32 to move between the upper die set 26 and lower die set 28. The strip 30 can be moved from station to station by pull rolls 34. The lower die set 28 remains stationary and the upper die set 26 reciprocates vertically toward and away from the lower die set 28. Each die set 26 and 28 has a plurality of mating die stations each giving a different form to the strip 30. After each reciprocation of the upper die 26, the strip 30 is advanced to the left as viewed in FIG. 2 the distance between adjacent stations. In actual practice the part 14 is formed at about twenty different stations although more stations may be used, some of which can remain idle if necessary.

Referring now to FIG. 3*a*, opposed dies in the upper die set 26 and in the lower die set 28 coact at a first station indicated at 40*a* to cut and define a circular work piece portion 42 with four inner arcuate slits 44 and four outer arcuate slits 46 which are cut on the slightly larger diameter than the slits 44 and which are rotated approximately 45° from the first set of slits 44. The slits 44 and 46 permit the circular work piece portion 42 to remain attached to the remainder of the strip 30 during the forming operations without restricting metal flow and at the same time permits the work piece portion to be advanced as a unit with all of the other work piece portions attached to the strip 30.

In the next station 40*b* a conventional male die section indicated diagrammatically at 48 and a female die indicated at 50 is used to draw or to form a shallow round cup 52. In the next several stations, which in actual practice may be as many as eight stations but which are not shown, dies similar to the male die 48 and female die 50 are used to reshape the cup 52 so that it becomes progressively deeper in axial length and smaller in diameter until a tube 54 is formed at station 40*c*.

At the next station, 40*d* the tube extending from the circular work piece portion 42 is given a more definite shape as seen in FIG. 5 in which a portion 56 of the tube most closely adjacent to the circular work piece 42 has a larger diameter than the lower portion of the tube indicated at 58.

Figure 6:
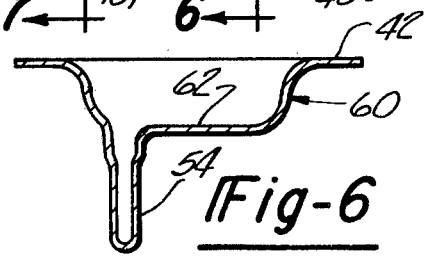

At the station indicated at 40*e* in FIGS. 3*b* and 6, the circular work piece portion 42 is formed between opposed male and female dies, not shown, to form a cup shaped portion 60 having a bottom wall 62 from which the tube 54 extends to one side and parallel to the axis of the cup shaped portion 60 and perpendicular to the bottom wall 62. Also the end of the tube may be pierced to form an opening 61 to provide a passage through the tube 54.

As seen at station 40*f* in FIGS. 3*b* and 7, mating dies 63 and 63*a* are used to reshape the cup shaped portion 60 seen in FIG. 6 to form the cup shaped portion 64 seen in FIG. 7. The cup shaped portion 64 has an annular wall 66 which diverges upwardly from the bottom wall 62. The annular wall 66 also includes that portion of the original bottom wall from which the tube 54 extends and as a consequence, the tube 54*a* in FIG. 7 is seen as extending at an angle to the axis of the cover member 12.

The formation of the cup shaped portions seen in FIG. 7 is facilitated by the configuration of the tubular portion 54 illustrated in FIG. 5 having the enlarged diameter portion 56 and the smaller diameter portion 58. Upon the formation in the dies 63 and 63*a* the enlarged diameter portion 56 flows into the bottom wall 62 and into the annular wall 66. It will be noted that the tube 54*a* seen in FIG. 7 has a substantially uniform cross section for its full length.

Figure 8:
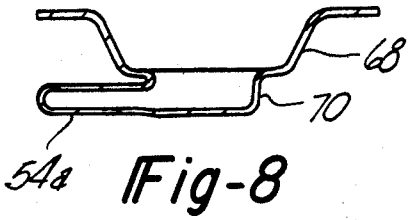

At the next station 40*g* seen in FIGS. 3*b* and 8, the cover member is reformed and results in a part in which the tube 54*a* extends radially to the axis of the cup shaped member 68 seen in FIG. 8. At station 40*g* the generally annular diverging wall 66 in FIG. 7 is reformed to form a vertical or axially extending wall 70 as best seen in FIG. 8 and since the axially extending wall 70 contains the tubular portion 54*a* the tube is positioned to extend radially of the cover member.

Figure 9:
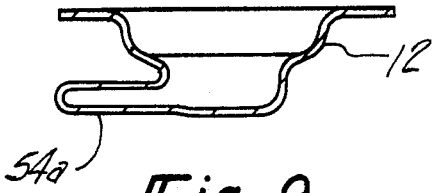

Movement of the tubular member 54*a* to the position illustrated in FIG. 8 is assisted by the die arrangements see in FIGS. 10 and 11. The lower die set 28 includes a female die portion 72 which is resiliently supported relative to a base 74 for movement from the position seen in FIG. 10 to the position seen in FIG. 11. Attached to the female die 72 is a cam member 76 pivoted at 78. In the partially open position of the die arrangement seen in FIG. 10 the cam 76 is in engagement with the tube 54*a* when it has the configurations and position seen in FIG. 7, that is, with the tube 54*a* extending at an angle to the axis of the cover 12. The die arrangement in FIG. 10 is in its partially closed position with the male die member 80 ready to engage the cover member 68. Upon engagement of the male die 80 with cover member 68, the cover member is moved downwardly into the cavity of the female die 72 so that the tube 54 slides in a slot 82 in the cam 76. As the cover member 68 becomes seated in the female die 72, the female die moves downwardly causing the cam 76 to pivot about its axis 78 and serves to move the tube 54*a* to a fully radially extending position as seen in FIG. 11. At a subsequent station indicated at 40*h* indicated in FIG. 3*b*, the cover member 68 with radially extending tube portion 54*a* may be further shaped or sized to form the contours of the finished cover 12 so that it appears as seen in FIG. 9. At a subsequent station in the progressive die arrangement which is not shown the cup shaped member with attached radially extending tube 54*a* is severed from the strip 30 and is allowed to drop into an accummulating bin 86 seen in FIG. 2. The scrap portion of the strip 30 may be cut up into smaller fragments for disposal and the finished cover member 12 is ready for assembly into the servo motor 10.

The method of forming a cup shaped housing member with an integral inlet tube from a flat continuous strip of metallic material has been provided in which the strip is partially cut to form a generally circular work piece and thereafter a cup shaped depression is formed offset from the axis of the circular work piece portion to form a tube. Subsequently a second cup shaped depression is formed which extends axially of the work piece portion with the tubular portion extending perpendicular to the bottom of the second cup. Thereafter, an annular diverging wall is formed to dispose the tube at an angle and finally the annular wall is displaced to extend axially with the tube extending radially of the circular work piece portion. Finally the circular work piece portion is severed from the strip of material.

The embodiments of the invention in which an exclusive property or privilege is claimed are defined as follows:

1. The process of forming a housing member with an integral inlet tube extending radially therefrom from a flat metallic member comprising: forming a circular work piece portion in said flat metallic member, progressively shaping said circular work piece portion to form a tube extending parallel to and at one side of the axis of said circular work piece portion, tilting the tube relative to said circular work piece portion to a position diverging from the axis thereof, displacing the tube from its diverging position to a radially extending position, and separating said cover from said flat metallic member.

2. The method of claim 1 in which said flat metallic member is a continuous strip of material.

3. The method of claim 1 in which said flat member is a substantially continuous strip of material and in which said circular work piece portion is worked on at progressive stations and remains attached to said strip until after displacement of said tube to its radially extending position.

4. The method of claim 1 in which said circular work piece portion is formed by partially cutting said flat member.

5. The combination of claim 1 in which said tube portion is tilted to a position diverging from the axis of said circular work piece portion by forming an annular wall diverging from the surface of said circular work piece portion.

6. The combination of claim 5 in which said annular wall is shaped to form a vertical wall to displace said tube to its radially extending position.

7. The method of claim 1 and further comprising the steps of forming the cup shaped depression in said circular work piece portion and at one side of the axis of said circular work piece portion, and progressively forming said cup shaped portion to reduce its diameter and increase its length to form said tube.

8. The combination of claim 1 in which said tube is formed to have a larger diameter adjacent to said circular work piece portion than at its free end.

9. The method of claim 1 in which dies are used to tilt said tubular portion from a position in which it is disposed at an angle to the bottom of the cup shaped portion and during formation of said vertical walls to displace said tubular portion radially to the axis of said cup shaped portion.

10. The method of forming a cup shaped housing member with an integral inlet tube from a flat strip of metallic material comprising; partially cutting said strip to define a generally circular work piece portion, forming a cup shaped depression in said circular work piece portion and at one side of the longitudinal central axis of said circular work piece portion, progressively forming said cup shaped portion to reduce its diameter and increase its depth to form a tube, forming a second cup shaped depression in said circular work piece portion to extend axially of the latter and symmetrically to said longitudinal central axis with said tubular portion extending perpendicular to the bottom of said cup shaped portion and to one side of the axis thereof, forming an annular wall in said cup shaped portion disposed at an angle to the bottom of said cup shaped portion, said annular wall including said tubular portion so that the latter extends at an angle to the axis of said cup shaped portion, displacing said annular wall portion to form vertical walls extending axially of said cup shaped portion with said tubular portion extending radially to the axis of said cup shaped portion, and separating said circular work piece portion from the remainder of said strip of material.

11. The combination of claim 10 in which said tubular portion is formed progressively at different die stations and in which said second cup shaped depression is formed progressively at different die stations.

* * * * *

UNITED STATES PATENT OFFICE

CERTIFICATE OF CORRECTION

Patent No. 4,117,708 Dated October 3, 1978

Inventor(s) Leon F. LaVene

It is certified that error appears in the above-identified patent and that said Letters Patent are hereby corrected as shown below:

Column 1, after Title delete "su"

Column 1, line 28, "housng" should read --housing--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*